United States Patent [19]

Flannigan

[11] 4,449,649

[45] May 22, 1984

[54] BULK MATERIAL CONTAINER

[75] Inventor: Jerry E. Flannigan, Century, Fla.

[73] Assignee: St. Regis Paper Company, West Nyack, N.Y.

[21] Appl. No.: 339,423

[22] Filed: Jan. 15, 1982

Related U.S. Application Data

[63] Continuation-in-part of Ser. No. 316,219, Oct. 29, 1981, abandoned.

[51] Int. Cl.[3] ..... B67D 5/06

[52] U.S. Cl. ..... 222/181; 222/105; 222/561; 383/42

[58] Field of Search ..... 229/17 SC; 150/1, 3, 150/12; 222/105, 556, 559, 561, 181; 294/67 DA; 383/42, 67

[56] References Cited

U.S. PATENT DOCUMENTS

| | | | |
|---|---|---|---|
| 3,282,621 | 11/1966 | Peterson | 222/181 |
| 3,301,452 | 1/1967 | Jester | 150/12 |
| 3,799,409 | 3/1974 | Goerke | 222/561 |
| 4,015,602 | 4/1977 | Nelson et al. | 222/561 |
| 4,052,866 | 10/1977 | Saunders | 222/105 |
| 4,081,011 | 3/1978 | Krause | 222/181 |
| 4,270,677 | 6/1981 | Schmidt | 229/60 |

*Primary Examiner*—H. Grant Skaggs
*Attorney, Agent, or Firm*—Joseph M. Maguire

[57] ABSTRACT

A bulk material container having a pair of slings connected to the sidewall thereof for supporting and transporting the container is provided with an opening in its bottom wall for dispensing bulk material therethrough. The opening is opened and closed by a slide valve gate having handles at opposed ends and an off-center opening adapted to be placed into full or partial registration with the opening in the bottom wall of the container to control the flow of bulk material from the container.

11 Claims, 11 Drawing Figures

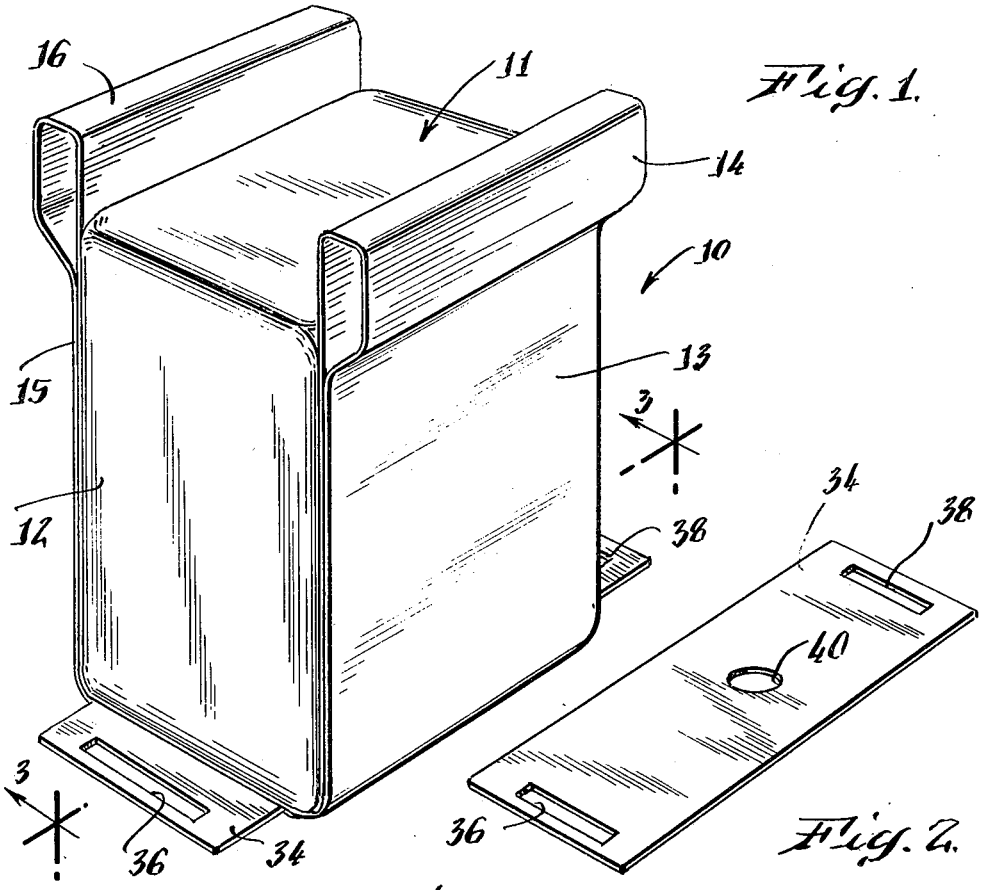
Fig. 1.
Fig. 2.
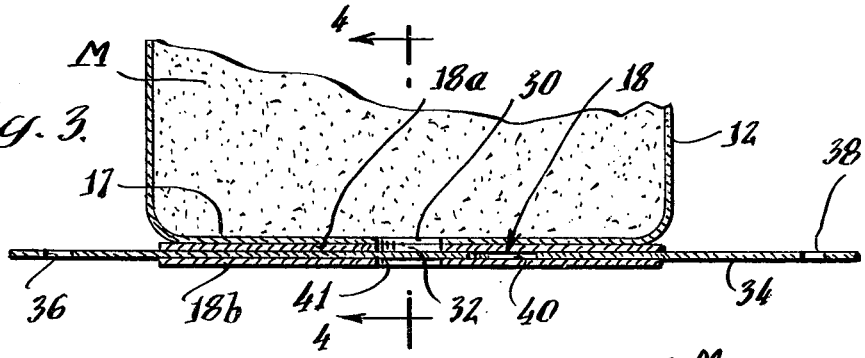
Fig. 3.
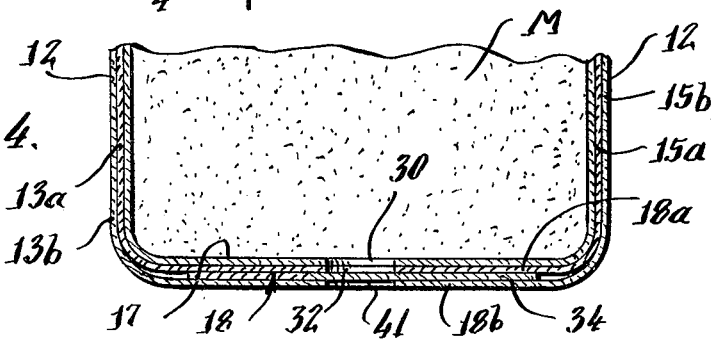
Fig. 4.

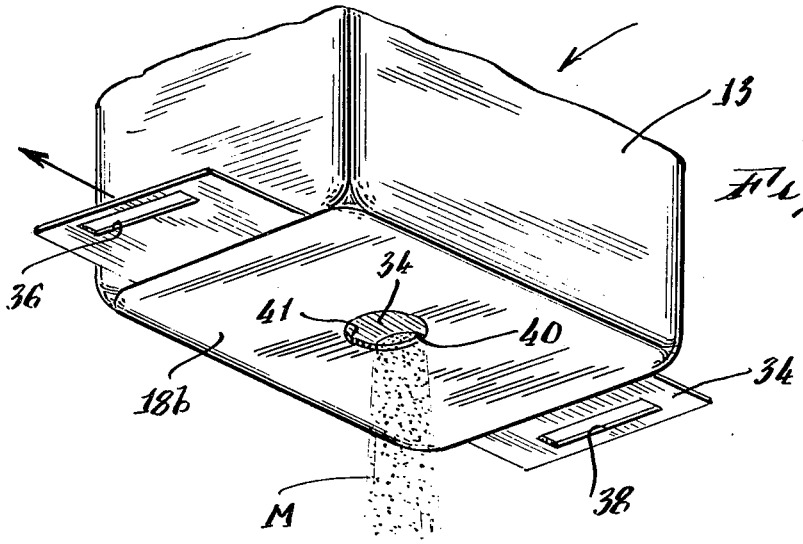
Fig. 7.
Fig. 8.
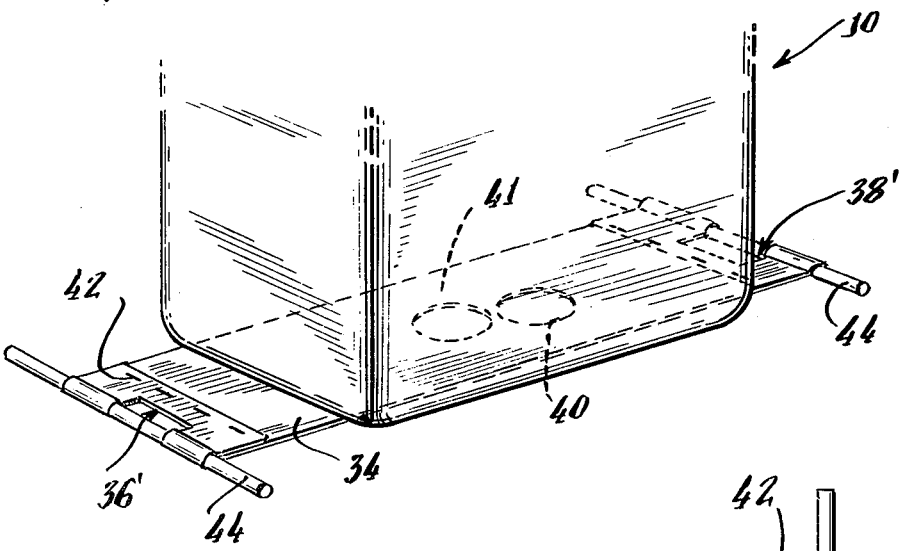
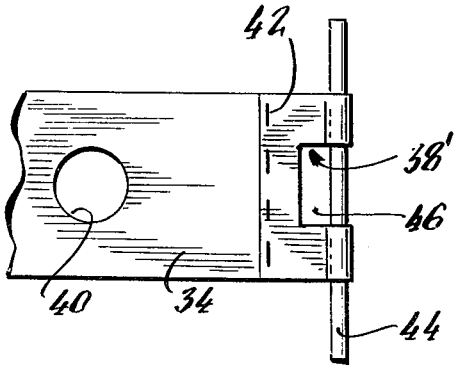
Fig. 9.

BULK MATERIAL CONTAINER

This is a continuation-in-part of my earlier filed U.S. patent application Ser. No. 316,219, filed Oct. 29, 1981, now abandoned.

TECHNICAL FIELD

The present invention pertains to bulk material containers and more particularly, to bulk material containers fabricated from reinforced kraft paper or the like, for transporting and storing bulk materials having means for dispensing bulk material from the bottom thereof.

PRIOR ART

Paper and paperboard containers are desirably used for transporting and storing materials due to their light weight and low cost as well as their capability of being stored in minimal space in a compact, folded, knocked-down state. For transporting and storing bulk materials, however, the structure of the containers must be sufficiently strong to hold extremely large weights, often on the order of a ton. Due to the large size and weight of the bulk material placed in the container, it has also been found desirable to construct such containers to permit dispensing of the contents from the bottom, thereby obviating the necessity of tipping the containers to remove the contents.

One such bulk material container is known as a sling bin and is manufactured by the St. Regis Paper Company of Nyack, N.Y. A sling bin is a large open mouthed bag adapted to be shipped and stored flat, which can be erected and filled with bulk material while suspended so that the total bin capacity can be utilized. The bin is provided with opposed loops extending upwardly from opposed portions of the bag mouth which are folded back upon themselves and secured to the bag sidewalls to form a pair of slings for suspending the bin from a pair of horizontal supports or the like provided in conjunction with a support frame. Spring clamps attached to the support frame are used to hold the bag or bin mouth open during filling of the bin with bulk material.

After filling, the bin can be transported to a storage or unloading site by the insertion of a pair of fork lifts of a forklift truck through the slings. The bin bottom was equipped with a solid paperboard one-way slide put in place during the bin construction. Access from one side only was possible and no handle was included. Complete removal of the slide valve or gate is necessary to initiate product withdrawal through a circular opening or hole centered in the bottom of the bin. However, no means were available to vary or stop the flow or removal of the product once the slide valve or gate was removed.

SUMMARY OF THE INVENTION

In order to rectify this condition and to provide control over the rate of flow or discharge of the bulk material from the bin, the bin bottom is provided with a double wall including a pair of aligned dispensing openings. A slide valve is inserted between the panels of the double wall of the bin bottom and has an off-center opening in the double wall to dispense the bulk contents of the bin. The flow of material from the bin can be controlled by partial in lieu of full registration of the dispensing openings in the bin bottom and slide.

However, if the bin is opened with the slide valve too far to one side or with insufficient extension from both sides of the bin bottom wall, the slide may be inoperable for its intended purpose either because it will be pinched or incapable of being slid axially along the bottom of the bin from one side thereof against the downward force of the great weight and bulk of material housed in the bin, or the slide valve cannot be gripped to be pushed and simultaneously pulled from opposed sides of the bin. Accordingly, the slide valve is provided with handles on both opposite, lateral ends thereof, which are accessible from both sides of the bin when the hole in the slide valve is in registration with the holes in the bin walls.

The handles may be cut openings in the slide valve or the valve may be doubled back upon itself at its opposite ends and fastened and a dowell inserted through the looped back portion to serve as a handle member.

BRIEF DESCRIPTION OF THE DRAWINGS

Further objects and advantages will become apparent from the following description and claims, and from the accompanying drawings, wherein:

FIG. 1 is a perspective view of the bulk material container of the present invention;

FIG. 2 is a perspective view of a slide valve used with the container of FIG. 1 to dispense bulk material from the container;

FIG. 3 is a cross-sectional view taken substantially along the plane indicated by line 3—3 of FIG. 1;

FIG. 4 is a cross-sectional view taken substantially along the plane indicated by line 4—4 of FIG. 3;

FIG. 7 is a partial perspective view of the bottom of the container of FIG. 6, further illustrating the manner in which material is dispensed from the container;

FIG. 8 is a partial perspective view of the bottom of the container of FIG. 1 equipped with an alternate type of slide valve;

FIG. 9 is a partial plan view of the slide valve shown in FIG. 8;

DETAILED DESCRIPTION

Figure 5:
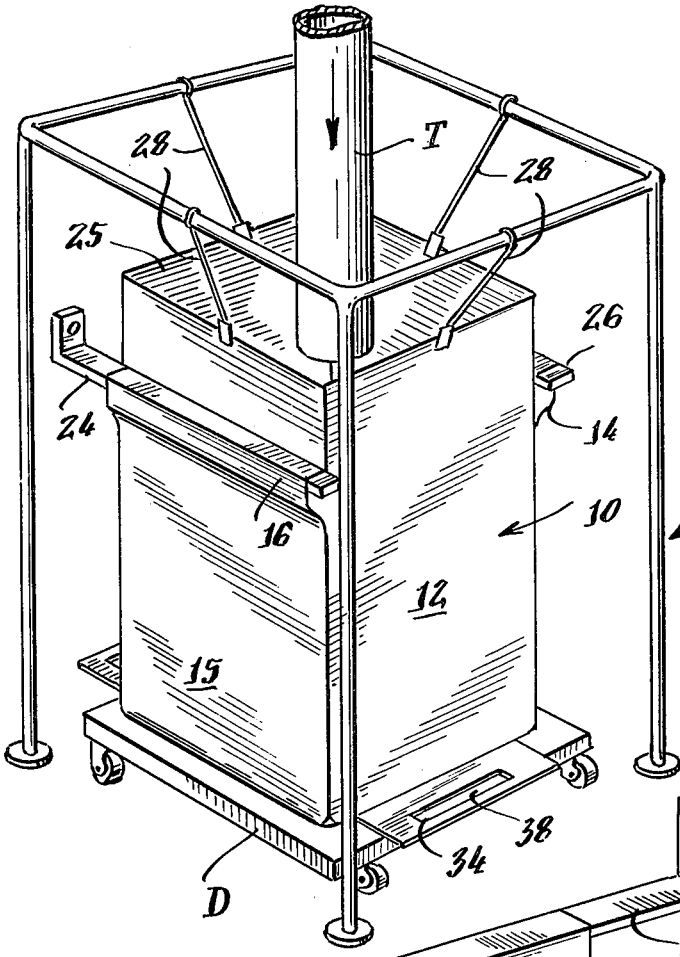
FIG. 5 is a perspective view of the container of FIG. 1 being filled.

Referring now to the drawings in detail, wherein like numerals indicate like elements throughout the several views, the bulk container or sling bin 10 of the present invention can include a bag member 11 having a sidewall 12 provided with looped extensions or slings 14, 16 formed by bending each of the ends of auxiliary sidewalls 13, 15, and bottom wall 18 secured to opposed portions of sidewall 12 and bottom wall 17 of bag 11 respectively, in a loop back upon itself and adhesively securing the loops or slings to the adjacent auxiliary sidewall member. Bag 11 can be constructed of kraft paper, polyethylene, aluminum foil/paper laminates, or other materials such as woven fabrics of polypropylene, polyethylene, or other synthetic or natural products. Additionally, a polyethylene liner (not shown) can be inserted into bag 11 for product protection. The auxiliary sidewalls 13, 15 and bottom wall 18 each contain an inner and outer ply of stiff paper material or woven synthetic fabric, the inner plies being designated 13*a*, 15*a* and 18*a*, while the outer plies are designated 13*b*, 15*b* and 18*b*, respectively. Typical materials which can be used for auxiliary sidewalls 13, 15 and bottom wall 18 are fiber reinforced kraft paper and woven polypropylene. The auxiliary sidewall plies 13*a*, 13*b* and 15*a*, 15*b* are adhesively bonded to each other, except along bottom wall portions 18*a*, 18 *b* for a purpose to be described hereinafter.

Figure 6:
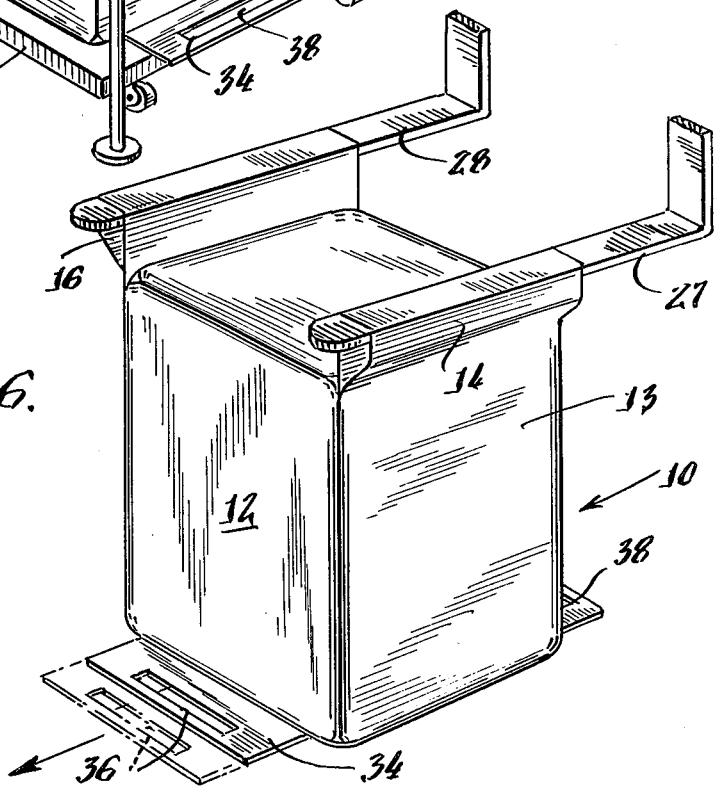
FIG. 6 is a perspective view illustrating the manner of transporting and dispensing bulk material from the container of FIG. 1.

As shown in FIG. 5, the bin 10 can be supported on a frame 22 by inserting looped extensions or slings 14, 16 on a pair of bars or pipe supports 24, 26, respectively, on frame 22. The bin mouth 25 is opened and spring clamps 28 are all connected between the mouth and frame 22 to hold the mouth 25 open. The combined bottom wall 17, 18 can be supported on a dolly D. The bin 10 can then be filled with bulk material from a tube T and after filling, the bin 10 can be closed and transported to storage or an unloading site by the insertion of a pair of fork lifts 27, 29 of a forklift truck through the slings 14, 16. (FIG. 6).

The bin bottom wall panels 17 and 18*a*, 18*b* are provided with registered openings 30, 32, and 41 respectively. Received between unsecured, spaced plies 18*a*, 18*b* of auxiliary bin bottom 18 is a slide valve plate 34 having a coating of silicone or polyethylene to reduce sliding friction. In general, slide valve plate 34 can be constructed of any thin material strong enough to hold the bulk material M contained in bag 11 while closed, and to be opened and closed under load. A low coefficient of friction is desired in order to facilitate sliding the valve. Typical materials include heavy duty kraft paper, liner board, synthetic plastic sheets of polyethylene, polypropylene, nylon or polycarbonate, or a laminate or sandwich of any of these materials. The slide valve 34 is provided with openings or handles 36, 38 on both opposite, lateral ends thereof, along with off-center opening 40 extending therethrough, which is adapted to be placed into and out of full or partial registration with openings 30, 32 and 41 in bottom wall 17 and plies 18*a*, 18*b* to control the flow rate and dispensing of bulk material M from bin 10, as shown in FIG. 7, from the interior of bin 10, through openings 30, 32, 40 and 41. The handle openings 36, 38, because of the off-set nature of opening 40, are accessible from both sides of the bin 10 when the opening 40 in the slide valve 34 is in partial or full registration with the holes or openings 30, 32, and 41 of the bin walls 17 and 18*a*, 18*b*.

As shown in FIGS. 8 and 9 the handles may be formed by doubling back upon itself the slide valve 34 at its opposite ends and fastening the valve to itself by staples or the like as shown at 42. A dowel 44 inserted through the looped back portion of slide valve 34 aids in gripping slide valve 34 through openings 46 cut in each looped end portion of slide valve 34.

Figure 10:
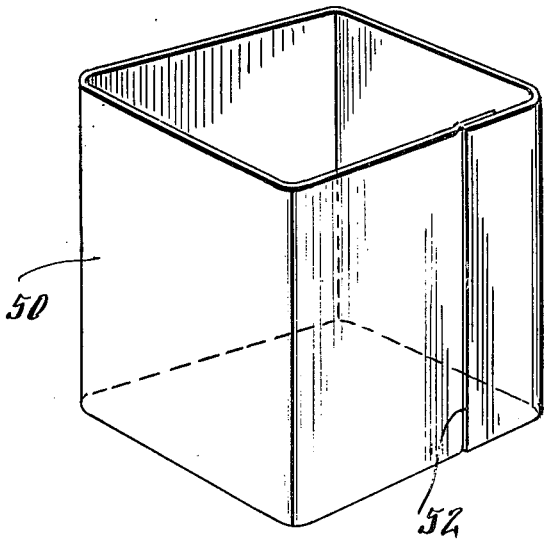
FIG. 10 is a perspective view of a reinforcing girdle for use with the bulk material container of the present invention.
Figure 11:
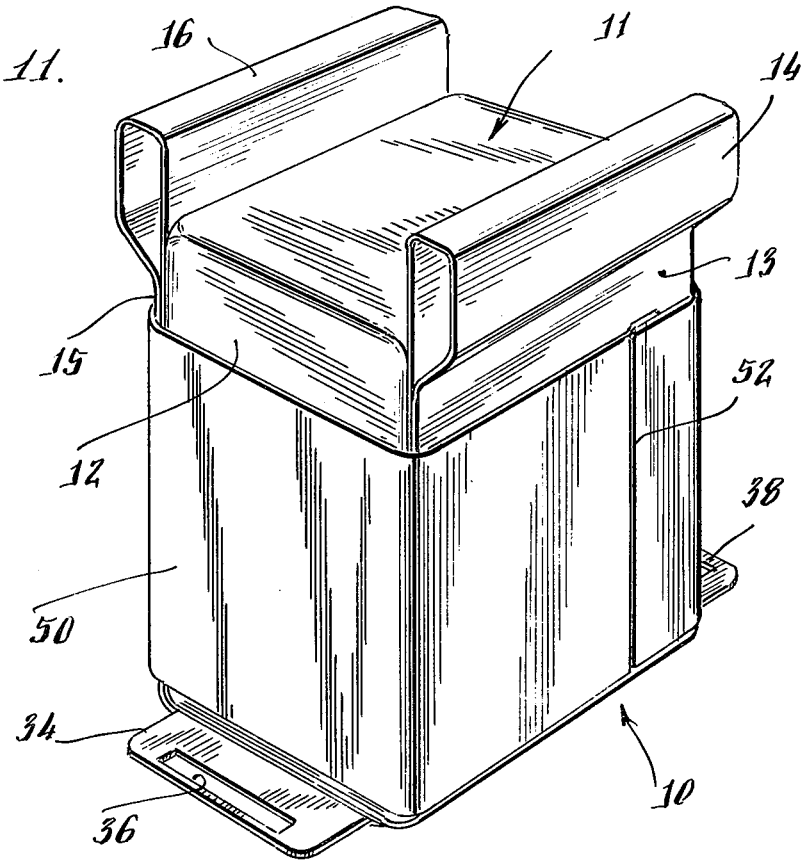
FIG. 11 is a perspective view of the bulk material container of the present invention having the girdle of FIG. 10 installed thereon.

Circumferential structural support can be added to bin 10 by providing a girdle 50 around bag 11 and auxiliary sidewalls 13, 15, as shown in FIGS. 10 and 11. Girdle 50 can be constructed of laminated, fiber reinforced kraft paper, or the like and in the form of a sleeve which is installed around the periphery of bag 11 and auxiliary sidewalls 13, 15. Girdle 50 is secured to bag 11 by adhesive means, such as glue spots located at various points on the interior surface of girdle 50. Girdle 50 includes a seam 52 which is adhesively sealed along its length.

It has been found that a girdle is useful when bag 11 and auxiliary sidewalls 13, 15 are constructed of paper materials, to add necessary strength to the overall bin assembly. Such a girdle has been found to be unnecessary when bag 11 and auxiliary sidewalls 13, 15 are fabricated from stronger, woven synthetic fabric materials.

I claim:

1. A bulk material container comprising:

a sidewall, a bottom wall closing one end of said sidewall, said bottom wall including a dispensing opening therethrough, a multi-ply looped sling extension wrapped around said container to enclose said bottom wall and opposite portions of said sidewall, thereby forming a sling for supporting and transporting said container, each of the plies of said looped sling extension which are adjacent said bottom wall including a dispensing opening therethrough, said dispensing openings all being in registration with each other;

slide valve means between a pair of adjacent plies of said multi-ply looped sling extension for controlling the rate of flow of bulk material dispensed from said container through said dispensing openings, said slide valve means including:

a push-pull plate so proportioned and constructed as to permit pushing and pulling at each end of the plate against the load of the material and having an opening extending therethrough which is adapted to be placed in and out of or in partial registration with the registered openings in said bottom wall and the plies of said looped sling extension, and handle means on each end of said push-pull plate for gripping and pushing and pulling said push-pull plate from opposite sides thereof.

2. The container of claim 1 wherein said handle means includes:

a slot cut in opposite ends of said push-pull plate.

3. The container of claim 2 wherein said slots are wholly within the interior area of said plate.

4. The container of claim 1 wherein said handle means includes:

opposed end portions of said push-pull plate doubled back and secured to the interior area of said plate, an opening extending from the interior of each doubled back portion to an end edge thereof, and a dowel for gripping said plate inserted through each of said doubled back plate portions across said opening.

5. The container of claim 1 wherein said push-pull plate is formed from kraft paper.

6. The container of claim 1 wherein said push-pull plate is formed from plastic.

7. The container of claim 1 wherein said opening in said plate is located closer to one of said handles than the other.

8. The container of claim 1 wherein said sidewall and said looped sling extension are formed from kraft paper.

9. The container of claim 1 wherein said sidewall and said looped sling extension are formed from a woven synthetic faric.

10. The container of claim 1 further comprising a girdle partially enclosing the periphery thereof.

11. The container of claim 1 further comprising means for securing said bottom wall to the adjoining, innermost ply of said looped sling extension.

* * * * *